US012329221B1

(12) United States Patent
Choi

(10) Patent No.: US 12,329,221 B1
(45) Date of Patent: Jun. 17, 2025

(54) FRONT FLAP-INTEGRATED UNIFORM WITH ANTI-LIFTING AND VOLUME RETENTION FUNCTIONS

(71) Applicants: Hae Young Choi, Daegu (KR); SW COMPANY CO., LTD., Daegu (KR)

(72) Inventor: Hae Young Choi, Daegu (KR)

(73) Assignees: Hae Young Choi, Daegu (KR); SW COMPANY CO., LTD., Daegu (KR)

( * ) Notice: Subject to any disclaimer, the term of this patent is extended or adjusted under 35 U.S.C. 154(b) by 0 days.

(21) Appl. No.: 18/959,604

(22) Filed: Nov. 26, 2024

(30) Foreign Application Priority Data

Dec. 14, 2023 (KR) ..... 10-2023-0181990

(51) Int. Cl.
*A41D 29/00* (2006.01)

(52) U.S. Cl.
CPC ..... *A41D 29/00* (2013.01); *A41D 2300/322* (2013.01)

(58) Field of Classification Search
CPC .. A41D 29/00; A41D 2300/322; A41D 31/02; A41D 1/22; A41D 27/02
USPC ..... 2/243.1, 92, 118
See application file for complete search history.

(56) References Cited

U.S. PATENT DOCUMENTS

2015/0335124 A1* 11/2015 Passarello ..... A45D 8/36 132/273
2020/0345085 A1* 11/2020 Iriarte Tineo ..... A41D 27/24

FOREIGN PATENT DOCUMENTS

JP 3214945 U 2/2018
KR 20-1999-0040143 U 11/1999
KR 10-1680039 B1 11/2016

* cited by examiner

*Primary Examiner* — Timothy K Trieu
(74) *Attorney, Agent, or Firm* — Revolution IP, PLLC

(57) ABSTRACT

The present disclosure relates to a front flap-integrated uniform with anti-lifting and volume retention functions that makes it extremely easy to wear the front flap-integrated with the uniform through zipper operation, that keeps firmly in contact with a body without shifting and retains the volume of the body even under various movements of the wearer because the degree of stretch of the fabric is actively maintained by embedding a silicone tape having set elasticity in the edge of the front flap, and that induces maximization of convenience and efficiency of use by employing the front flap having a general configuration different from the related art.

3 Claims, 6 Drawing Sheets

FRONT FLAP-INTEGRATED UNIFORM WITH ANTI-LIFTING AND VOLUME RETENTION FUNCTIONS

CROSS-REFERENCE TO RELATED APPLICATION

This application claims the benefit of priority under 35 U.S.C. § 119 (a) to Korean Patent Application No. 10-2023-0181990, filed on Dec. 14, 2023, the entire contents of which are incorporated herein by reference.

BACKGROUND

(a) Technical Field

The present disclosure relates to a front flap-integrated uniform, and more specifically to a front flap-integrated uniform with anti-lifting and volume retention functions that makes it very easy to wear the front flap integrated with the uniform through zipper operation, that keeps firmly in contact with a body without shifting and retains the volume of the body even under various movements of the wearer because the degree of stretch of the fabric is actively maintained by embedding a silicone tape having set elasticity in the edge of the front flap, and that induces maximization of convenience and efficiency of use by employing the front flap having a general configuration different from the related art.

(b) Background Art

In general, a uniform is a compound word generated from un us and forma of Latin and refers to clothing indicating a predetermined shape or outward appearance. A uniform is also used as a word that means a regulation dress, has a specific shape and necessary accessories and functions in accordance with the object unlike casual wear, and generally refers to a distinctive outfit.

For example, a "Uniform with the Function of Preventing Foreign Material" has been disclosed in Korean Patent Publication No. 10-1680039 as a technical spirit related to a uniform. This uniform is based on the type with separate upper garment and lower garment, in which the upper garment is composed of a non-exposed part at a lower portion that has a side slit and an exposed part at an upper portion that does not have a side slit, and the non-exposed part is composed of: a rear part that is positioned under the side slit and is inserted into the lower garment when the uniform is worn; and a front part that is positioned at the front and is positioned outside the lower garment when the uniform is worn, in which at least two or more extraction slots that are long up and down are provided at the upper portion of the front part such that a belt loop can be pulled outside the upper garment, a first fixing member is provided under the extraction slots of the front part, and a second fixing member corresponding to the first fixing member is provided at the lower garment, so that the upper garment can be fixed to the lower garment by fastening or bonding between the first fixing member and the second fixing member with the portion under the extraction slots of the front part of the upper garment folded inward.

As another technical spirit similar thereto, a "Uniform" has been disclosed in Korean Utility Model Application Publication No. 20-1999-0040143. This uniform is composed of: a pair of front panels that has shoulder portions at the upper portion, has arm holes at the upper portions of the sides, and has diagonal portions diagonally cut from the ends to the center portions of the shoulder portions at portions facing the arm holes; a back panel that has a groove, at which a neck part is positioned, at the center of the upper portion, has shoulder portions respectively corresponding to the shoulder portions provided at a pair of pressing panel at both sides of the groove, has arm holes the same as the arm holes formed at the pair of front panels, respectively, at the upper portions of the sides, and is coupled to allowance lines of the pair of front panels by stitching; a collar that has a round portion coupled with the same curvature as the groove of the back panel at the center of the inner side, has diagonal portions extending at a predetermined slope from the round portion and coupled to the diagonal portions of the front panels, and has a predetermined continuous curvature on the outer side; a pair of sleeves coupled to the arm holes formed at the front panels and the back panels, respectively; a fixing member for fixing the pair of front panels; and a piece of interfacing formed to prevent twisting of the groove formed at the back panel by combining the groove of the back panel and portions of the diagonal portions formed at the pair of front panels, respectively.

As described above, various efforts are being made to enhance the functionality of uniforms and improve the comfort of wearing them, and particularly, in the case of the "Uniform" of in Korean Utility Model Application Publication No. 20-1999-0040143, it is configured to be able to contribute to maintaining dignity by preventing exposure of the body of the wearer by configuring a front flap at the front opening.

However, not only the front flap of the "Uniform" of in Korean Utility Model Application Publication No. 20-1999-0040143, but the front flaps of all of existing clothing are fixed to the upper garment using buttons, so, according to this fixing type, when a wear bends forward, a gap space is formed between the front flaps and the body, so the function of the front flaps is lost.

PRIOR ART DOCUMENTS

Patent Documents (Patent Document 1) Korean Patent Publication No. 10-1680039, "Uniform with the Function of Preventing Foreign Material"

(Patent Document 2) Korean Utility Model Application Publication No. 20-1999-0040143, "Uniform"

SUMMARY OF THE DISCLOSURE

The present disclosure has been made in an effort to more actively solve the general problems described above and an object is to provide a uniform in which an upper garment covering the upper body of a wearer and a front flap protecting the chest part of the wearer are integrated.

Further, another object of the present disclosure is to provide a technique that makes it very easy to wear a front flap integrated with a uniform by improving the structure such that the front flap can be simultaneously worn in the process of wearing an upper garment.

Further, the present disclosure is intended to provide a front flap that maintains a curved line to correspond to the external appearance of a wearer, and further a still another object is to provide a technique that prevents exposure of a body by employing the general configuration for preventing shifting by increasing the tight fit to a body on the basis of elasticity.

In order to achieve the objects described above, a front flap-integrated uniform with anti-shifting and volume retention functions proposed by the present disclosure has the following configuration.

The front flap-integrated uniform proposed by the present disclosure is integrally configured by an upper garment 10 covering an upper body of a wearer; and a front flap 20 extending from a lining of the upper garment and covering a chest part of the wearer to maintain volume and prevent body exposure, wherein the front flap 20 is connected to or separated from the upper garment 10 by a zipper operation, thereby contributing to convenience of wearing.

Further, the front flap 20 includes: a first covering part 21 extending from a lining at a side of the upper garment 10 and protecting a portion of the chest of a wearer; a second covering part 22 extending from a lining at another side of the upper garment and protecting a portion of an upper body of the wearer, and connected with the first covering part; and a zipper part 23 attached to surfaces, where the first covering part and the second covering part are connected, and contributing to connection and separation of the first covering part and the second covering part.

Further, the front flap 20 is made of a spandex material.

Further, the front flap 20 includes a silicone tape 20-1 embedded along the edge of the front flap to prevent the cloth from shifting.

Further, the silicone tape 20-1 is fixed and sewn by basting and stitching after being positioned at a set position with the front flap 20 pulled and extended to both sides.

Further, the front flap 20 has a curve and a line corresponding to a chest of a wearer by vertically cutting the front flap from a position corresponding to the chest of the wearer to a lower end, and overlaying and stitching the cut portions.

Meanwhile, the upper garment 10 includes a back part 11 disposed on the back of a wearer; a first sleeve 12 extending from the right side of the back part and covering the right arm of the wearer; a first front part 13 extending from the right side of the back part and disposed on the right upper body part of the wearer; a second sleeve 14 extending from the left side of the back part and covering the left arm of the wearer; and a second front part 15 extending from the left side of the back part and covering the left upper body part of the wearer, wherein the upper portion of the first covering part 21 is configured by a first close contact portion 21*a* extending from the first front part 13 at a set angle along the right shoulder line; and a second close contact portion 21*b* extending horizontally from the first close contact portion and disposed in close contact with the right collarbone and portions of the upper portions of the right chest and the left chest of a wearer.

Further, the upper portion of the second covering part 22 includes: a third close contact portion 22*a* extending at a set angle along the left shoulder line from the second front part 15; and a fourth close contact portion 22*b* horizontally extending from the third close contact portion and disposed in close contact with the left collarbone and the upper portions of the left chest of a wearer.

Further, the zipper part 23 includes a first rail 23*a* stitched along an end of the first covering part 21; a second rail 23*b* stitched along an end of the second covering part 22 that faces the first covering part; and a locking tab 23*c* fitted on the first rail and the second rail and engaging the first rail and the second rail by sliding, wherein the locking tab 23*c* is coupled and fixed to the second rail 23*b* and is configured to be able to be coupled to and separated from the first rail 23*a*, and the front flap 20 is stored with the locking tab 23*c* separated from the first rail 23*a* and with the first covering part 21 and the second covering part 22 separated from each other, and in order to wear the uniform, the locking tab 23*c* is coupled to the first rail 23*a*, and the first rail and the second rail 23*b* are engaged, so the first covering part and the second covering part are connected to each other and protect the chest and a portion of the upper body of a wearer.

According to the present disclosure having the configuration described above, there is an effect that since the upper garment and the front flap are integrally formed, storage and maintenance are extremely easy, the convenience of wearing is maximized by the operation of the zipper provided at the front flap, and wearability is very outstanding because a spandex material is used.

Further, since the silicone tape is embedded along the edge of the front flap, not only the elasticity of the fabric is improved, but the stretched state is actively preserved. Accordingly, the present disclosure exhibits the effect that it maintains the volume of a body and makes curved lines clear while keeping in close contact with the body of a wearer, and it actively prevents the chest from being exposed to the outside because shifting of the front flap is prevented even under various movements of the wearer.

DETAILED DESCRIPTION

Figure 1:
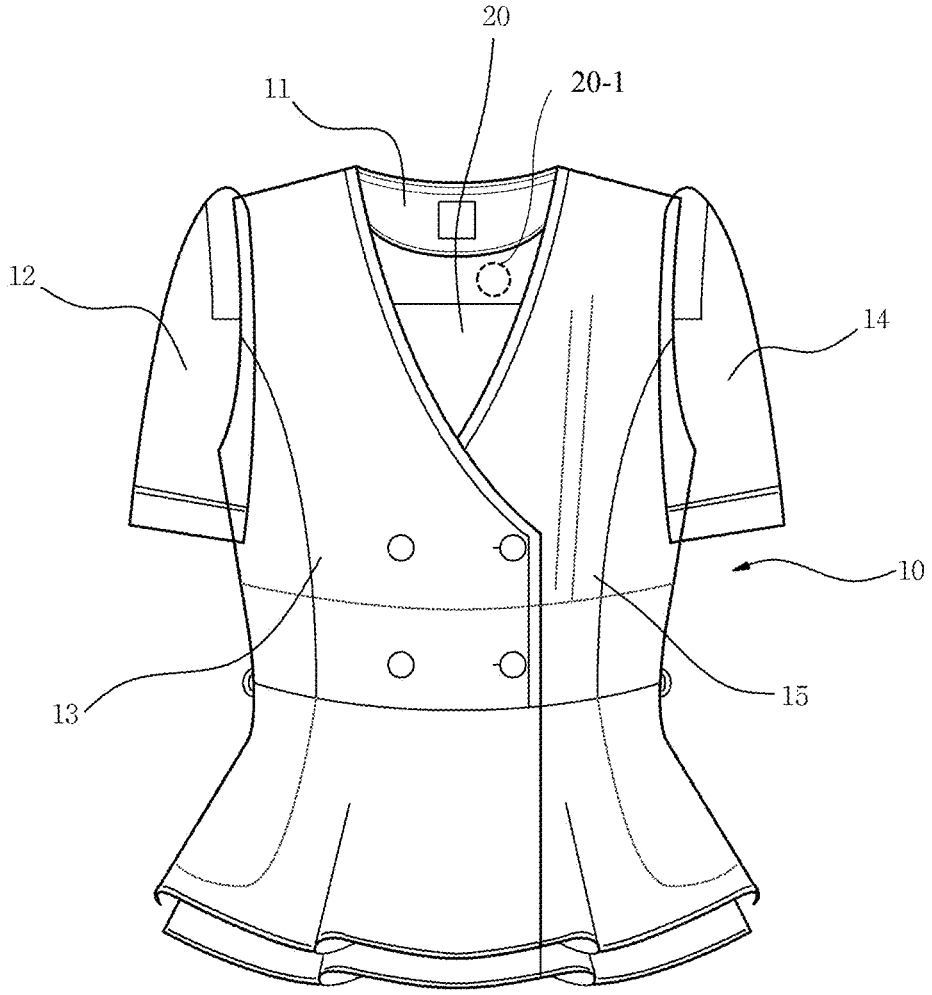
FIG. 1 is a front view of a uniform configured by a preferred embodiment of the present disclosure.

Hereinafter, the configuration of the present disclosure and the corresponding operations and effects are collectively described with reference to the accompanying drawings.

The advantages and features of the present disclosure, and methods of achieving them will be clear by referring to the embodiments that will be described in detail below with reference to the accompanying drawings. However, the present disclosure is not limited to the embodiments disclosed hereafter and may be implemented in various ways, and the embodiments are provided to complete the disclosure of the present disclosure and let those skilled in the art completely know the scope of the present disclosure, and the present disclosure is only defined by the scope of claims. Like reference numerals indicate the same components throughout the specification.

The present disclosure relates to the technical spirit of a front flap-integrated uniform.

It should be noted that the present disclosure, above all, relates to a front flap-integrated uniform with anti-lifting and volume retention functions that makes it extremely easy to wear the front flap integrated with the uniform through zipper operation, that keeps firmly in close contact with a body without shifting and retains the volume of the body even under various movements of the wearer because the degree of stretch of the fabric is actively maintained by embedding a silicone tape having set elasticity in the edge of the front flap, and that induces maximization of convenience and efficiency of use by employing the front flap having a general configuration different from the related art.

Figure 2:
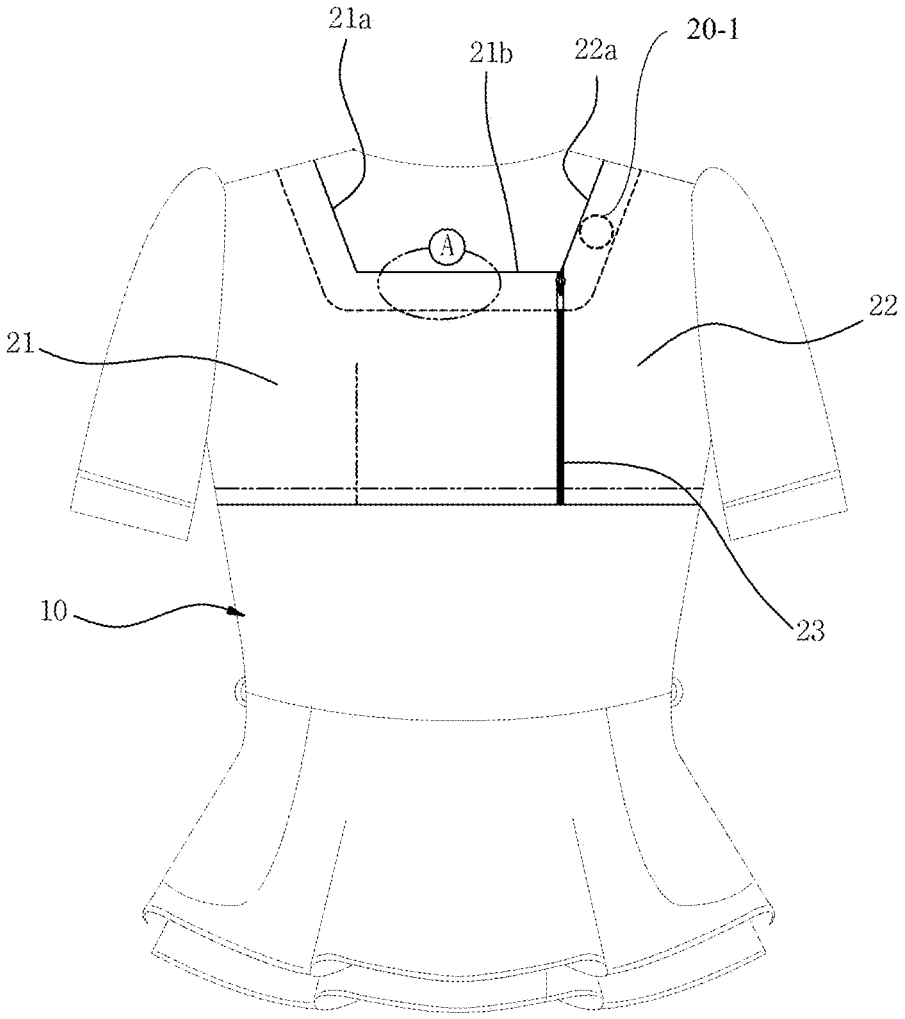
FIG. 2 is an exemplary view when a front flap proposed by the present disclosure is applied.
Figure 3:
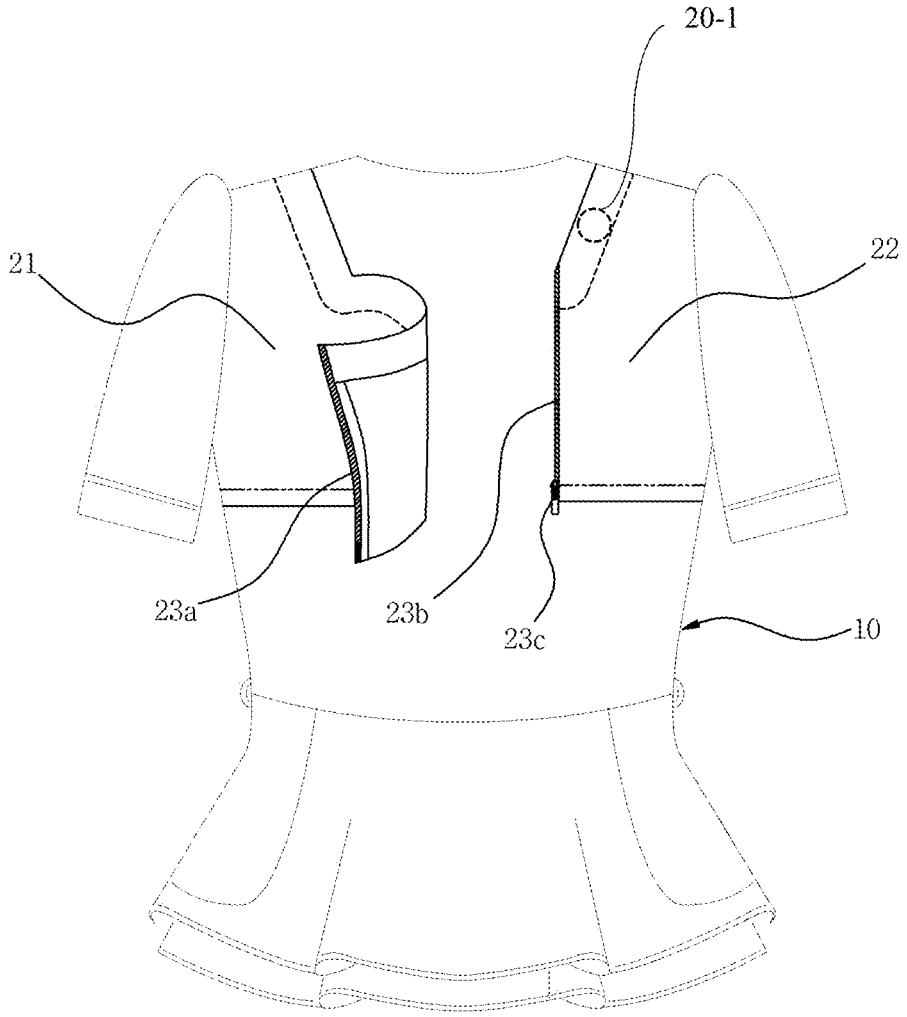
FIG. 3 is an exemplary view when the front flap is connected and opened by a zipper proposed by the present disclosure.
Figure 4:
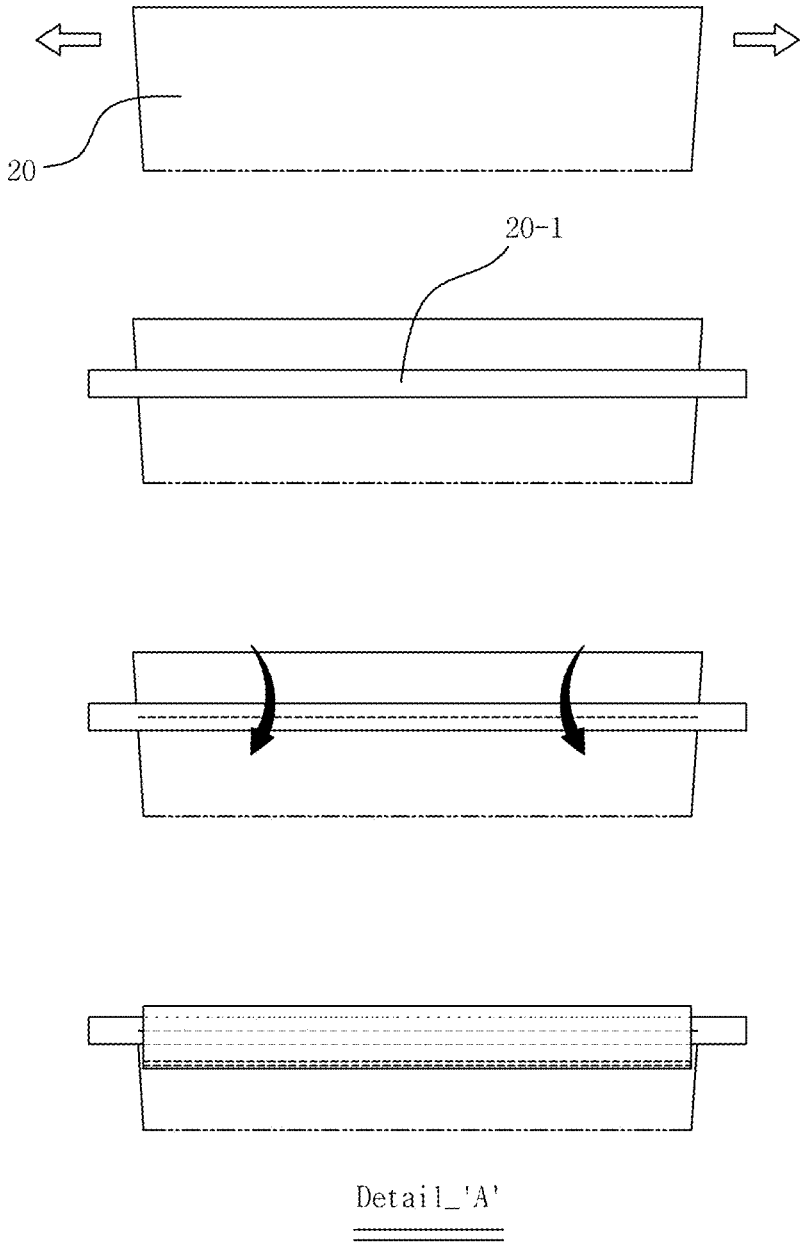
FIG. 4 is an exemplary view showing a process of embedding a silicone tape proposed by the present disclosure.
Figure 5:
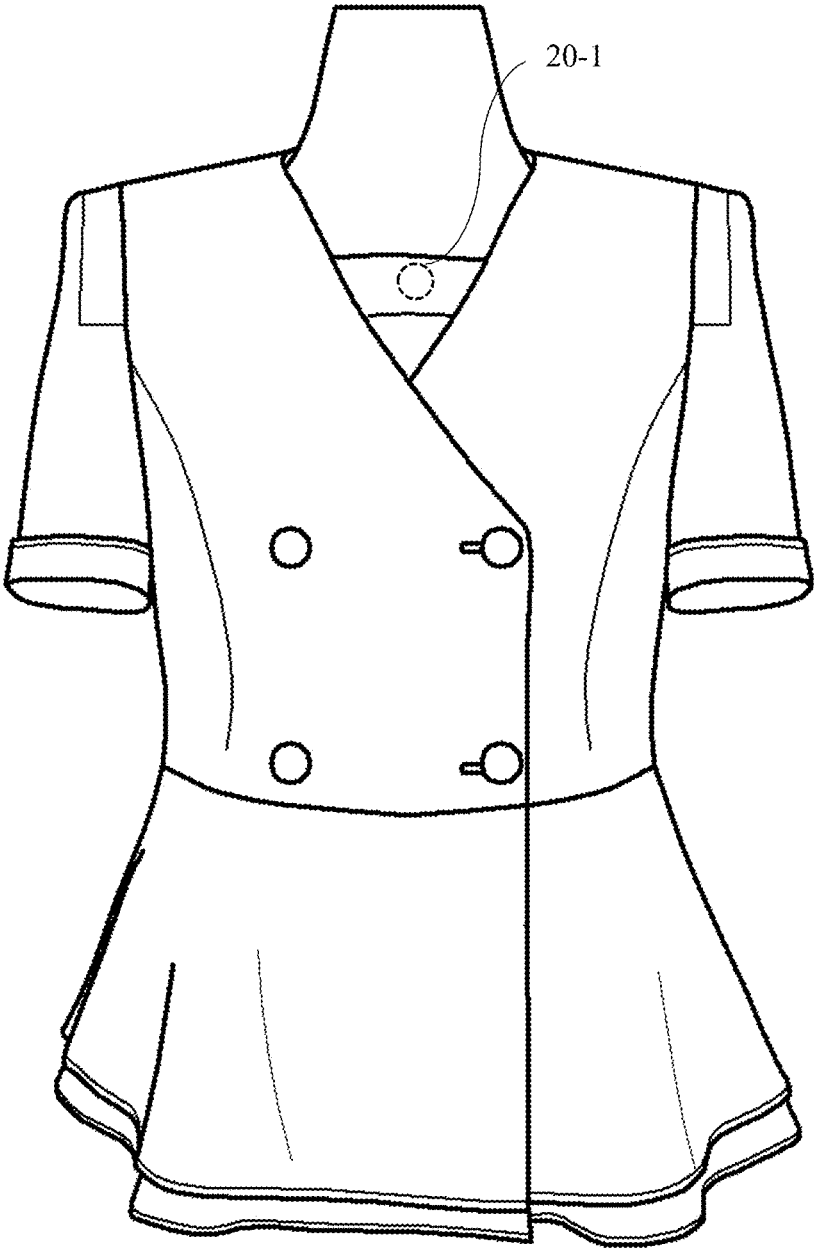
FIG. 5 is an exemplary picture of the uniform proposed by the present disclosure.
Figure 6:
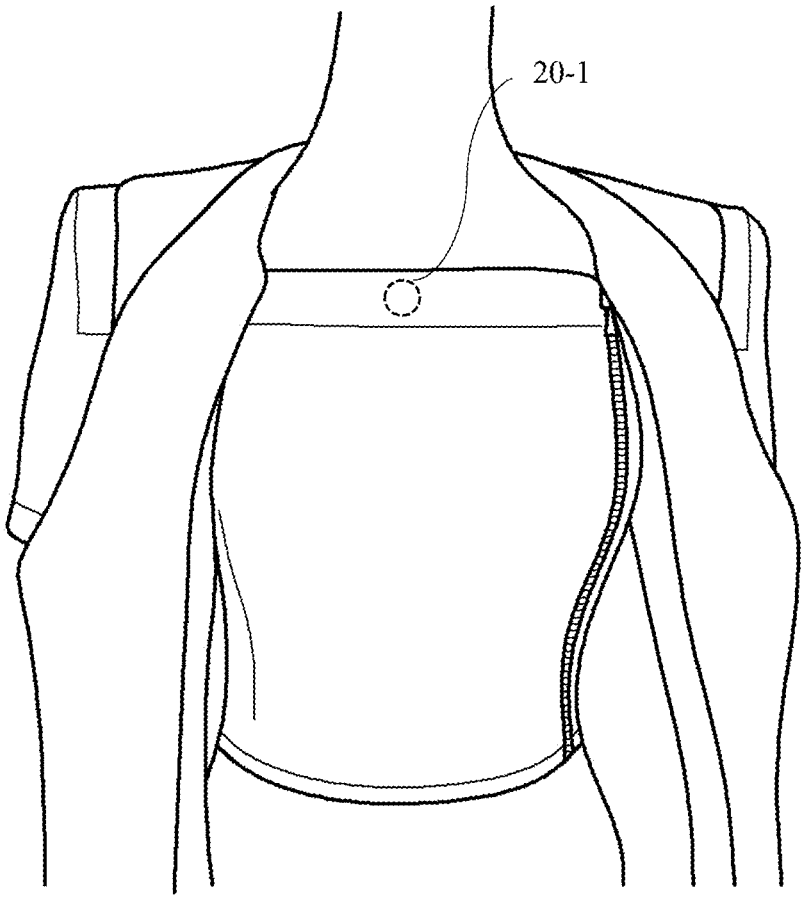
FIG. 6 is an exemplary picture showing the configuration of the front flap of the uniform proposed by the present disclosure.

FIG. 1 is a front view of a uniform configured by a preferred embodiment of the present disclosure, FIG. 2 is an exemplary view when a front flap proposed by the present disclosure is applied, FIG. 3 is an exemplary view when the front flap is connected and opened by a zipper proposed by the present disclosure, FIG. 4 is an exemplary view showing a process of embedding a silicone tape proposed by the present disclosure, FIG. 5 is an exemplary picture of the uniform proposed by the present disclosure, and FIG. 6 is an exemplary picture showing the configuration of the front flap of the uniform proposed by the present disclosure.

As shown in the figures, the present disclosure relates to the upper garment of a uniform, and in particular, a uniform that maximizes the convenience of storage, management, and wearability because a front flap is integrally formed inside the upper garment. However, the upper garment of the uniform of the present disclosure is shown in a suit type, but this is only an embodiment for description and the type of the upper garment can be replaced with all types such as a workwear, a school uniform, a sportswear, Hanbok, and Dobok.

A uniform of the present disclosure is composed of: an upper garment 10 covering the upper body of a wearer; and a front flap 20 extending from the lining of the upper garment and covering the chest part of the wearer.

The upper garment 10 is composed of: a back part 11 disposed on the back of a wearer; a first sleeve 12 extending from the right side of the back part and covering the right arm of the wearer; a first front part 13 extending from the right side of the back part and disposed on the right upper body part of the wearer; a second sleeve 14 extending from the left side of the back part and covering the left arm of the wearer; and a second front part 15 extending from the left side of the back part and disposed on the left upper body part of the wearer.

The upper garment 10 is configured in a type that positioning the first front part 13 on the right upper body of a wearer and then overlapping and fixing the second front part 15 on the first front part using buttons. As described above, when the first front part 13 and the second front part 15 are positioned on the upper body of a wearer, a deep V-shaped portion is formed at the neck part of the wearer.

When a wearer wearing this type of upper garment 10 performs an action such as bending the waist to lower the upper body, the chest of the wearer may be partially exposed to the outside. According, in order to prevent this, the front flap 20 is integrally configured inside the upper garment 10, thereby protecting the chest part of a wearer, including the neck part.

In particular, the front flap 20 is connected to or separated from the upper garment 10 by zipper operation, thereby actively improving the convenience of wearing.

The front flap 20 is composed of: a first covering part 21 extending from the lining at a side of the upper garment 10 and protecting a portion of the chest of a wearer; a second covering part 22 extending from the lining at another side of the upper garment and protecting a portion of the upper body of a wearer, and connected with the first covering part; and a zipper part 23 attached to the surfaces, where the first covering part and the second covering part are connected, and contributing to connection and separation of the first covering part and the second covering part.

The first covering part 21 is made of a spandex fabric, exhibits set elasticity, comes in close contact with the upper body of a wearer, and is made of a rectangular fabric having a set length, so that a side of the first covering part 21 is connected with the first front part 13 of the upper garment 10 by stitching and another side is coupled to the zipper part 23 to be connected to and separated from the second covering part 22.

In this configuration, the upper portion of the first covering part 21 that is positioned at the neck part of a wearer is composed of: a first close contact portion 21*a* extending from the first front part 13 at a set angle along the right shoulder line; and a second close contact portion 21*b* extending horizontally from the first close contact portion and disposed in close contact with the right collarbone and portions of the upper portions of the right chest and the left chest of a wearer.

Since the first covering part 21 extends from the lining of the first front part 13, it covers the area from the right armpit to the left chest of a wearer, thereby maintaining and preserving the volume of the right chest and the curvature of the right upper body line. Further, the first covering part 21 comes in close contact with the right chest along the right upper body line, thereby protecting the body not to be exposed to the outside even under intense movement of the wearer.

The second covering part 22, similar to the first covering part 21, is made of a spandex fabric, exhibits set elasticity, and comes in close contact with the upper body of a wearer. The second covering part 22 is made of a rectangular fabric having a set length, and a side thereof is connected with the second front part 15 of the upper garment 10 by stitching and another side is coupled to the zipper part 23 to be connected to and separated from the first covering part 21.

In this configuration, the upper portion of the second covering part 22 that is positioned at the neck part of a wearer includes a third close contact portion 22*a* extending at a set angle along the left shoulder line from the second front part 15.

Since the second covering part 22 extends from the lining of the second front part 15, it covers the area from the left armpit to the left chest of a wearer, thereby maintaining and preserving the volume of the left chest and the curvature of the left upper body line. Further, the second covering part 22 comes in close contact with the left chest along the left upper body line, thereby protecting the body not to be exposed to the outside even under intense movement of the wearer.

The zipper part 23 is composed of: a first rail 23*a* stitched along an end of the first covering part 21; a second rail 23*b* stitched along an end of the second covering part 22 that faces the first covering part; and a locking tab 23*c* fitted on the first rail and the second rail, respectively, and engaging the first rail and the second rail by sliding.

The locking tab 23*c* is configured in a coupled state to the second rail 23*b* and is configured to be able to be coupled to and separated from the first rail 23*a*. Accordingly, the front flap 20 is typically stored with the locking tab 23*c* separated from the first rail 23*a* and with the first covering part 21 and the second covering part 22 separated from each other, and in order to wear the uniform, the locking tab 23*c* is coupled to the first rail 23*a*, and the first rail and the second rail are engaged, so the first covering part and the second covering part are connected to each other and protect the chest and a portion of the upper body of a wearer.

In particular, a silicone tape 20-1 is embedded along the edge of the front flap 20 of the present disclosure, so it is the main feature to prevent shifting of the cloth. In this configuration, the edge means the upper line of the front flap 20, that is, the first close contact portion 21*a*, the second close contact portion 21*b*, and the third close contact portion 22*a*, and the silicon tape 20-1 is embedded at the corresponding position, whereby the elasticity of the upper line of the front flap is maximized.

The method of embedding the silicone tape 20-1 can be understood with reference to FIG. 4.

Referring to FIG. 4, first, the front flap 20 is prepared in a stretched state by puling the upper end of the front flap 20, that is, the portion to be the upper line, and the silicone tape 20-1 is positioned at the lower end slightly adjacent to the upper line and is then basted, thereby fixing the silicone tape to the front flap 20. Further, the silicone tape 20-1 is covered by folding the upper line of the front flap 20, and in this state, by stitching along the folded portion while avoiding the silicone tape, the silicone tape is sewn.

The front flap 20 with the silicone tape 20-1 embedded therein, as described above, exhibits strong elasticity at the neck part, so shifting is prevented when the uniform is worn. Accordingly, even though a wearer intensively moves, for example, bends at the waist, the unfolded state of the front flap is actively preserved and is not shifted, so it is possible to prevent exposure of the body of the wearer.

The detailed description of this is as follows.

The horizontal length of the edge of the front flap is set to fit the body size of a wearer, and in this case, the horizontal length of the front flap should be laterally expanded or extended to the level at which shifting can be prevented, and in this state, the silicone tape is joined and embedded, whereby the edge area of the front flap is held in the unfolded state by the silicone tape. Accordingly, the state extended to a predetermined length is continuously maintained without deformation, so the shifting phenomenon can be completely solved.

Meanwhile, the front flap 20 proposed by the present disclosure includes the function of retaining the fullness of a curve protruding forward to correspond to the volume of the chest of a wearer. This fullness can be generated at both of the first covering part 21 protecting the right chest and the second covering part 22 protecting the left chest.

The fullness can be formed through a process of vertically cutting the first and second covering parts 21 and 22 from the portions where the nipples of the chest are positioned to the lower ends, overlaying the left fabric and the right fabric to cross each other with the cutting line therebetween, and then fixing the overlaid portions through stitching.

Accordingly, the overlaid portions have a predetermined conical shape, that is, fullness corresponding to the curves of the chest of a wearer, somewhat reduce the pressure on the chest of the wearer due to the tight fit of the front flap 20, and actively contribute to improving the fullness by accentuating the chest line of the wearer.

Further, the conical shape itself prevents wrinkling of the fabric, thereby also producing various effects such as maintaining the fit of the uniform for a long period of time.

According to the uniform of the present disclosure having the configuration described above, since the upper garment and the front flap are integrally formed, storage and maintenance are very easy. Further, the convenience of wearing is maximized by the operation of the zipper provided at the front flap, and wearability is very outstanding because a spandex material is used.

Further, since the silicone tape is embedded along the edge of the front flap and actively contributes to improving the elasticity of the fabric, the uniform is completely brought in close contact with the body of a wearer, maintains the fullness of the body, and makes the curved line clear. Further, shifting of the front flap is prevented even under various movements of a wearer, so exposure of the chest to the outside is actively prevented. Accordingly, the ease of handling, use, maintenance, and repair resulting from the differentiated structure maximizes convenience and efficiency of use.

Although the present disclosure has been described with reference to the embodiments illustrated in the drawings, it should be noted that those are only examples and may be changed and modified into other equivalent embodiments from the present disclosure by those skilled in the art. Accordingly, the true technical protective range of the present disclosure should be construed by the accompanying claims, and all technical ideas within the equivalent range should be construed as being included in the patent right of the present disclosure.

What is claimed is:

1. A front flap-integrated uniform with anti-shifting and volume retention functions comprising:

an upper garment (10) covering an upper body of a wearer and having a V-shaped portion formed at a neck part of the wearer; and a front flap (20) extending from a lining of the upper garment, covering a chest portion of the wearer to maintain volume and prevent body exposure, and being integrally configured with the upper garment (10), wherein the front flap (20) is connected to or separated from the upper garment (10) by a zipper operation by a zipper part (23), wherein the front flap (20) prevents shifting of cloth by embedding a silicone tape (20-1) along an edge of the V-shaped portion, wherein the front flap (20) is configured to retain a fullness of a curve protruding forward to correspond to a volume of the chest portion of the wearer, and wherein the silicone tape (20-1) is fixed and sewn by basting and stitching after being positioned at a set position with the front flap (20) pulled and extended to both sides, wherein the front flap (20) includes:

a first covering part (21) extending from a lining at a side of the upper garment (10) and protecting a portion of the chest portion of the wearer; and a second covering part (22) extending from a lining at another side of the upper garment, protecting a portion of an upper body of the wearer, and connected with the first covering part, wherein the zipper part (23) is configured to connect or disconnect the first covering part and the second covering part.

2. The front flap-integrated uniform of claim 1, wherein the front flap (20) is made of a spandex material.

3. The front flap-integrated uniform of claim 1, wherein the curve of the front flap (20) has a line corresponding to the chest portion of the wearer by vertically cutting the front flap from a position corresponding to the chest portion of the wearer to a lower end, and overlaying and stitching the cut portions.

* * * * *